United States Patent [19]

Wolfe

[11] Patent Number: 4,770,412

[45] Date of Patent: Sep. 13, 1988

[54] FREE STANDING, SELF-RIGHTING SCULPTURED PUNCHING BAGS

[76] Inventor: Henry S. Wolfe, 2785 Kipps Colony Dr., Unit #101, Gulfport, Fla. 33707-3947

[21] Appl. No.: 20,469

[22] Filed: Mar. 2, 1987

[51] Int. Cl.[4] ..... A63B 69/00; A63H 3/06; A63H 13/18

[52] U.S. Cl. ..... 272/77; 446/226; 446/325

[58] Field of Search ..... 446/267, 325, 396, 224, 446/225, 226, 220, 326; 272/77, 76

[56] References Cited

U.S. PATENT DOCUMENTS

| | | | |
|---|---|---|---|
| 3,163,419 | 12/1964 | Lemelson | 446/325 X |
| 3,591,975 | 7/1971 | Terc | 446/225 |
| 4,268,030 | 5/1981 | Richards | 446/226 X |
| 4,529,390 | 7/1985 | Levy et al. | 446/220 |
| 4,655,722 | 4/1987 | Baron et al. | 446/325 X |

FOREIGN PATENT DOCUMENTS 8118 of 1915 United Kingdom ..... 446/226

OTHER PUBLICATIONS

"Punch Me's", Sear's Christmas Catalog, p. 547, 1974.

*Primary Examiner*—Mickey Yu
*Attorney, Agent, or Firm*—Ronald E. Smith

[57] ABSTRACT

A free-standing, self-righting punching bag having utility as a toy. The punching bag is sculptured and three dimensional; it is provided with a water-filled flexible enclosure at its lowermost end which serves as a counterweight to right the bag when it has been toppled by a punch or kick. In a first embodiment, a hollow tube member that also serves as a fill spout maintains the enclosure in its original shape at all times. In a second embodiment, a pair of strap members maintain the enclosure in its original shape and the fill spout is provided as a separate member which is positioned on the bottom of the toy.

18 Claims, 3 Drawing Sheets

FREE STANDING, SELF-RIGHTING SCULPTURED PUNCHING BAGS

BACKGROUND OF THE INVENTION

1. Field of the Invention

This invention relates, generally, to self-righting punching bag toys and more particularly relates to a self-righting toy having water as its counterweight means.

2. Description of the Prior Art

Free standing, self-righting punching bag toys are well known. Typically, the toys have the general shape of a bowling pin or an elongated egg and Bozo the Clown or a similar character are silk screened thereonto.

As such, the toys are not sculptured, i.e., they lack three dimensional parts such as hands, arms, distinct waistlines and the like.

The toys that were known heretofore employed a counterweight means such as sand to provide their self-righting function.

The present inventor is unaware of any earlier free standing punching bags that employ water as their self-righting means, but it is nonetheless presumed that water-weighted self-righting punching bags have been provided in the past.

Sand has provided the needed counterweight in the known earlier toys, as aforesaid, and countless sand-weighted punching bags have been sold.

The cost of the bags is quite high, however, because the sand must be added to the toy at the factory; shipping costs are thus high and this cost is passed on to the consumer.

The present inventor first substituted water for sand in a typical sand-counterweighted punching bag of the prior art to determine whether such a substitution would provide an operative toy. It was found that water was unacceptable as a replacement for sand because once the toy was knocked over, the enclosure containing the water would deform and as a result, little or no self-righting was possible.

In other words, the inventor's experiments found that the counterweight-containing enclosure would retain its original shape and thus remain operative at all times when sand was contained therein, because sand is not as fluid as water and the sand-containing enclosure does not appreciably deform when the toy is knocked into a horizontal position, and that a simple substitution of water for sand renders the device inoperative.

However, the possible use of water as a counterweight-providing means remained intriguing because if a water-reliant self-righting means could be found, then the cost of shipping the toys could be appreciably lowered because said toys could be shipped empty and the needed water could be added by the consumer.

The only obvious solution to the problem was to increase the rigidity of the enclosure so that it would retain its shape even when the toy was knocked over. Unfortunately, that solution would produce a toy that could not be shipped in a folded flat condition since the counterweight enclosure would then bulge upwardly and greatly increase the space required to ship the item. Thus, the gains in eliminating the weight of sand would be offset by the extra space required for the item.

The art is believed to contain no teachings or suggestions as to how water could be used in a self-righting toy having a flexible counterweight enclosure means.

SUMMARY OF THE INVENTION

The invention enables the use of water as a counterweight means in a free standing, self-righting punching bag toy.

In a first embodiment, an operative shape of a flexible enclosure means is maintained at all times by a hollow tube member that extends between the top of the enclosure and a predetermined point on an internal side wall of the toy that is above the top of the enclosure.

The distal end of the tube member is in fluid communication with the interior of the enclosure; the proximal end of the tube member is formed into a fill spout means so that water is charged into the enclosure through the tube that supports it.

The tube is downwardly inclined from its proximal to its distal end and as a result, when the enclosure is properly filled the tube will be air filled and the probability of leakage of water from the toy through the tube is eliminated when the toy is in its upright position.

A water-tight closure means in the form of a press fit plug member and a threaded cap member ensure against water leakage even when the toy is in its horizontal position.

In a second embodiment, a pair of diametrically opposed strap members extend from the top of the flexible enclosure to predetermined points on internal side walls of the toy that are above the top of the enclosure.

In said second embodiment, the fill spout is provided on the bottom of the toy but the same closure means in the form of a press fit plug member and a threaded cap still ensure against water leakage.

In both embodiments, the enclosure support means maintains the water-filled enclosure in its proper, operative shape even when the toy is knocked over.

Accordingly, this invention represents a breakthrough in self-righting toy construction, and pioneers the art of water-counterweighted self-righting toys.

It is therefore understood that the primary object of this invention is to advance the art of free standing, self-righting punching bag toys by providing a structure where water can be employed as the counterweight means.

Another important object is to provide suggestions on further ways to accomplish the foregoing object in view of the suggestions and examples disclosed herein.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
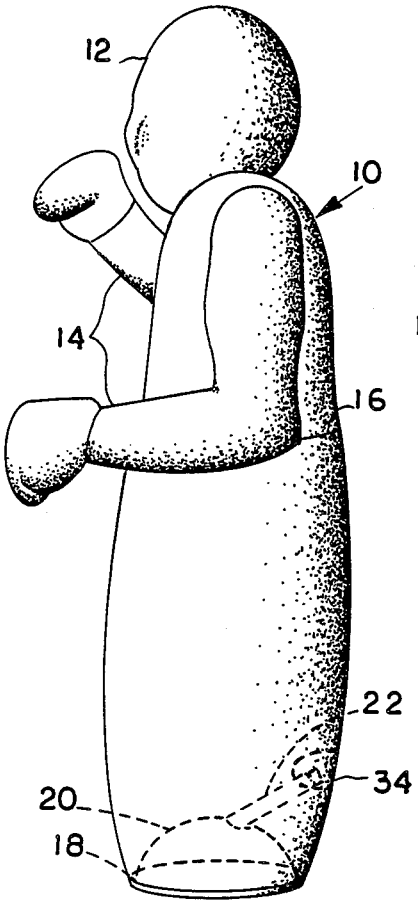
FIG. 1 is a left side view of a first embodiment of the novel structure.

A sculptured, three dimensional, free standing, self-righting punching bag is shown in FIG. 1 and is denoted 10 as a whole.

Figure 2:
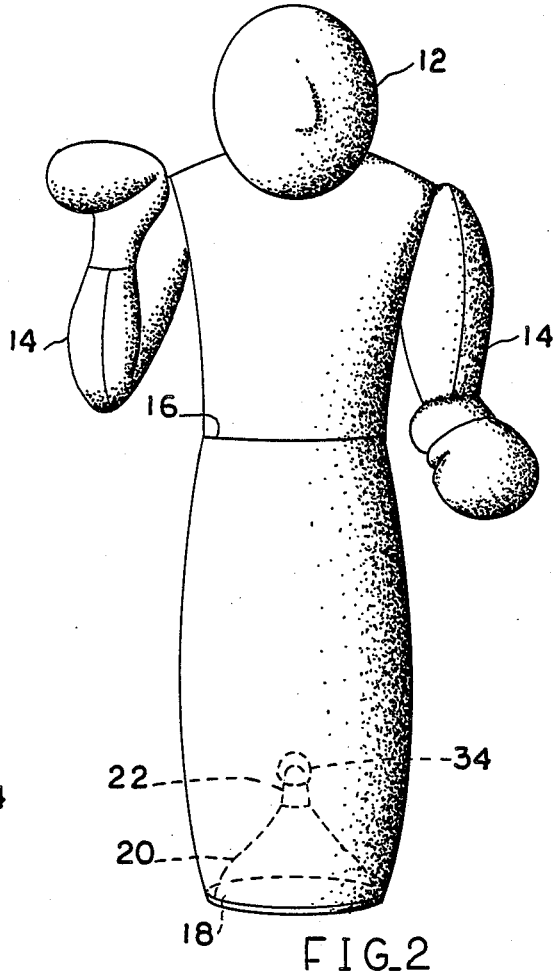
FIG. 2 is a frontal view of the structure shown in FIG. 1.
Figure 3:
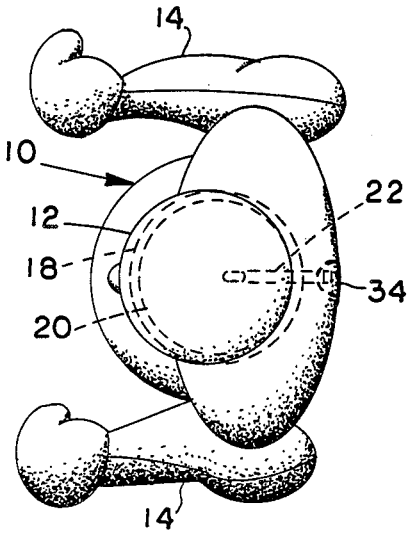
FIG. 3 is a top plan view of the structure positioned as in FIG. 1.
Figure 4:
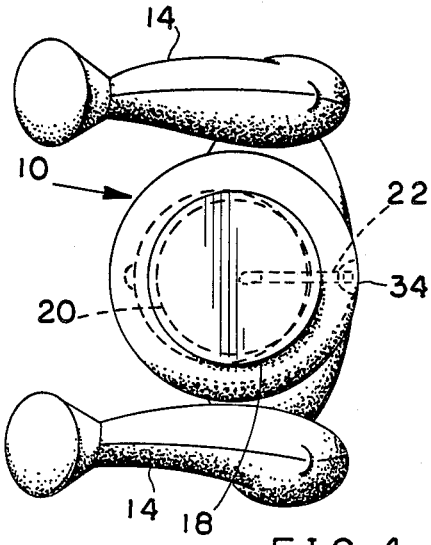
FIG. 4 is a bottom plan view of the structure positioned as in FIG. 1.
Figure 5:
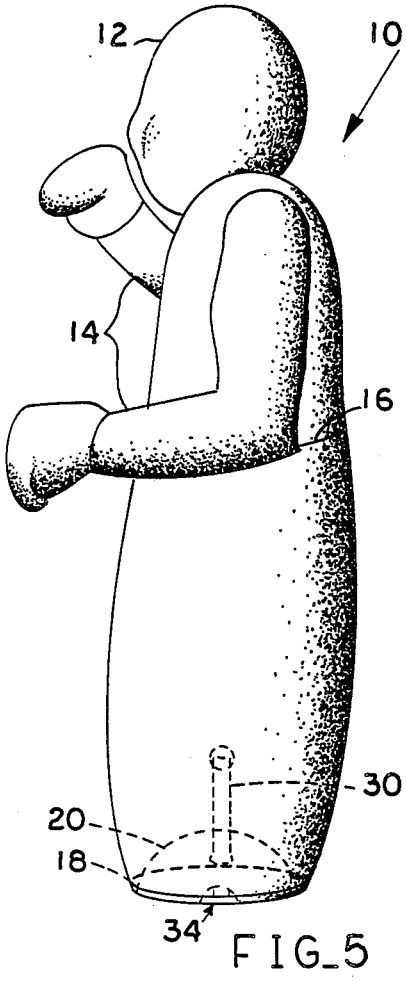
FIG. 5 is a left side view of a second embodiment of the novel structure.
Figure 6:
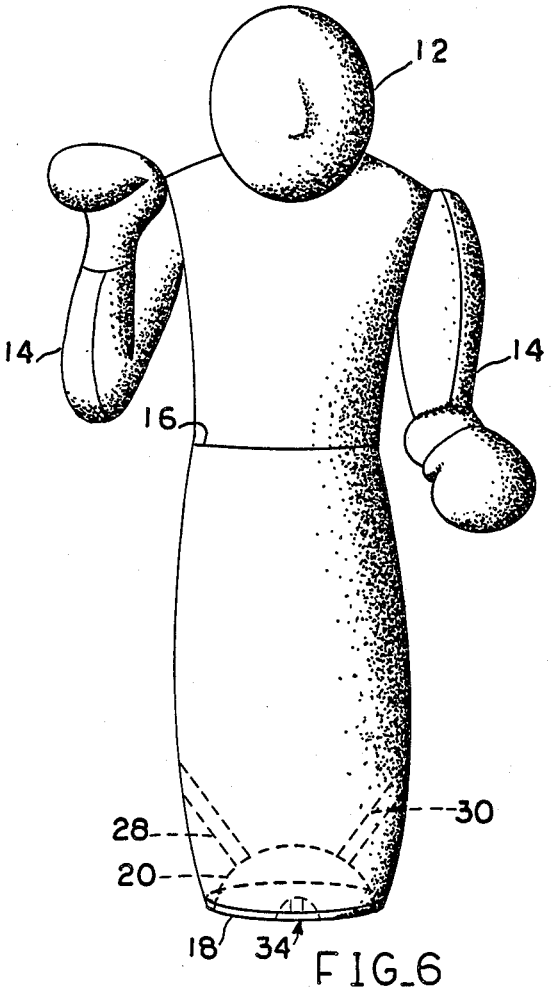
FIG. 6 is a frontal view of the structure shown in FIG. 5.

Unlike the egg-shaped structures of the prior art, article 10 is sculptured to provide a distinct head 12 having a projecting nose to render the same more life-like, arms 14 positioned in a boxing configuration, said arms showing bulging biceps and the fists thereof being sculpted to have a boxing glove appearance, and a distinct waistline 16, perhaps best depicted in FIG. 2.

The illustrated embodiment of the novel structure is formed of clear vinyl and is printed in color with art-work provided under license by owners of trademark rights to boxing characters. Other embodiments are sculptured in karate poses and are printed with licensed art work from the owners of trademark rights to karate characters, and so on.

Thus, an entire line of characters can be provided in three dimensional sculptured form; Japanese Ninja fighters and the like are all suitable for use in connection with self-righting punching bags, for example.

Accordingly, a child may play with one or more of the novel toys positioned in surrounding relation to himself or herself, and can enjoy punching, karate-style kicking and the like against numerous "adversaries" at once. Since the "adversaries" are provided with harmless but projecting limbs, the child can pretend to be knocked over if caught by an upraised leg, for example, of a self-righting karate figure, or by an arm 14, for another example. The possibilities for imaginative play are endless.

The lack of three dimensional sculpturing in the prior art toys reduced the level of imaginative play since projecting limbs were not provided. In contrast, a child playing with a self-righting punching bag of the type disclosed herein can actually develop defensive skills by dodging uprighting arms and legs.

The low cost of the novel toy makes it available to youngsters of all income groups, and the low cost nature of the item is a result of its use of water as a counterweight means.

The toy 10 has a substantially flat, circular base means 18.

The novel structure that allows the use of water as a counterweight means includes a flexible enclosure member 20, a hollow vinyl tube 22 and a closure means 34 for capping the tube.

Air is charged into the toy 10 by one or more conventional inflation valve members, not shown; it should be understood from the outset that all of the interior cavity of toy 10 is air-filled with the exception of the enclosure member 20.

Figure 9:
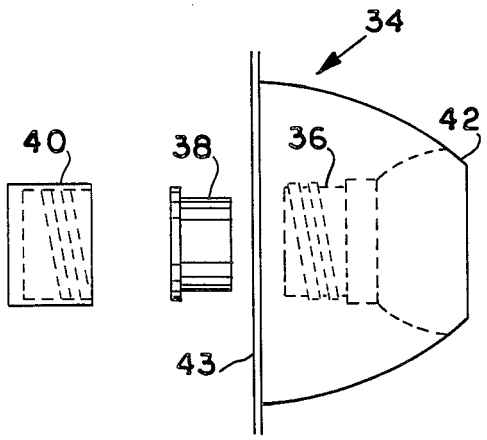
FIG. 9 is a side elevational, exploded view of the closure means employed in both embodiments of the novel structure.
Figure 10:
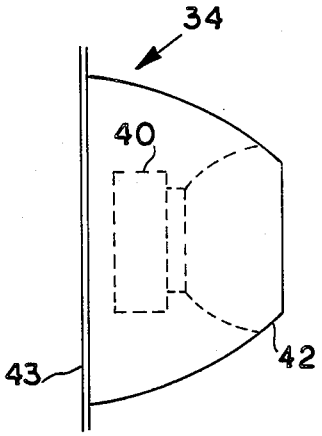
FIG. 10 is a side elevational view of the closure means of FIG. 9 in its assembled configuration.
Figure 11:
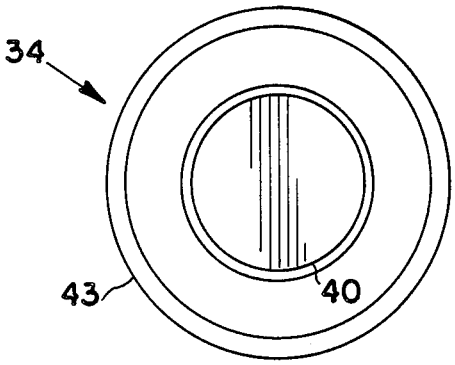
FIG. 11 is a front elevational view of said closure means.

The distal end of tube 22 is confluent with the uppermost point of flexible enclosure 20 as shown; the proximal end of tube 22 extends to closure means 34 (FIGS. 9, 10 and 11). Closure means 34 is heat sealed about its periphery to the body of toy 10 to prevent air leakage.

Closure means 34 is positioned at a height above the uppermost point of enclosure member 20 as shown; as a result, the proximal end of tube member 22 is higher than the distal end of said tube member which is confluent with the uppermost part of enclosure 20 as aforesaid and as is clearly shown.

Thus, tube 22 has a downwardly inclined disposition as shown. Enclosure 20 is properly filled when filled to its top with water by the consumer introducing water thereinto through tube 22.

Tube 22 is not filled with water and thus remains empty when enclosure 20 has been properly filled as aforesaid, i.e., tube 22 is occupied by nothing but air under atmospheric pressure. Since water does not flow uphill, tube 22 will remain air-filled when the toy 10 is upright and will only briefly fill with water when the toy is knocked over; it will empty of water as soon as the toy returns to its upright configuration.

Closure means 34, described more fully hereinafter, ensures against leakage during the transitory moments water is in tube 22.

The preferred shape of enclosure 20 is best understood by a comparison of FIGS. 1 and 2; as perhaps best understood in connection with FIG. 2, the preferred shape of enclosure 20 provides a large base rounding or converging to an almost pointed top.

The diameter of the base portion of enclosure 20 is less than the diameter of base member 18 of the toy. In a commercial embodiment of the invention, the diameter of the base of enclosure 20 is about four inches (4") less than the diameter of toy base 18; accordingly, a two inch (2") flat annular region surrounds the base of the enclosure 20 as is well shown in FIGS. 1 and 2.

Thus, the bulk of the water in enclosure 20 is contained in the bottom thereof and is centrally disposed relative to base member 18 of the toy. Accordingly, such water is properly positioned to serve as an effective counterweight means that will quickly upright the toy whenever it is knocked over.

The amount of water in the top of the enclosure 20 is less than the amount of the water in the bottom of the enclosure 20. Absent a means for maintaining the unique shape of the enclosure 20, however, said enclosure 20 would simply deform under the influence of the water contained therein whenever the toy was knocked over and no acceptable self-righting feature would be provided.

It should therefore be understood that tube 22 serves two functions. Its primary function is to serve as a support means that maintains the operative configuration of the flexible enclosure 20 at all times, even when the toy is knocked over. Its secondary function is to serve as a fill spout for flexible enclosure 20 so that the toy 10 can be shipped empty of water in a flat condition and later filled with water through said tube 22 by the consumer.

The proximal end of tube 22 is preferably mounted to an internal sidewall of toy 10 at a position higher than the highest point of the enclosure 20; the FIGS. depict such an operative positioning of tube 22. Those skilled in the art of mechanical design will appreciate the fact that the specific positioning of tube 22 is not otherwise critical.

Closure means 34 is preferably positioned on the back of toy 10 as depicted, although, again, such positioning is not critical; FIGS. 1–4 depict the preferred positioning of said closure means.

The recessed or countersunk form of closure means 34 is not critical per se; closure means 34 could extend beyond the plane of the toy's profile and the toy would still function. However, a projecting closure means would subject tube 22 and enclosure member 20 to externally imparted forces repeatedly impinging thereagainst attendant successive topplings of the toy, it being understood that the preferred countersunk design of closure means 34 effectively protects said parts from such needless debilitation.

A second embodiment of the invention appears in FIGS. 5–8, to which FIGS. attention is now directed.

Tube 22 is not employed in this second embodiment. In lieu thereof, a pair of strap members 28, 30 are employed to maintain the operative shape of enclosure member 20 at all times.

Figure 7:
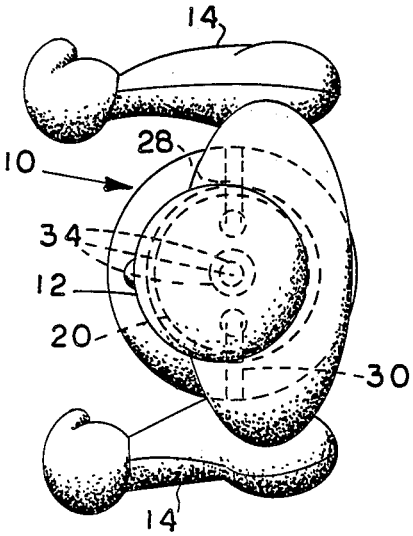
FIG. 7 is a top plan view of the structure positioned as in FIG. 5.
Figure 8:
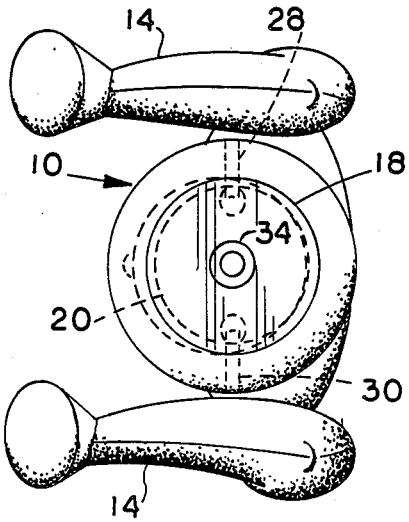
FIG. 8 is a bottom plan view of the structure positioned as in FIG. 5.

Strap members 28, 30 are preferably diametrically opposed to one another as perhaps best understood in connection with FIGS. 7 and 8. As in the first embodiment, it is critical to attach, by heat sealing or other suitable means, the proximal end of each strap member to an internal sidewall of the toy at a point preferably higher than the highest point of the enclosure member 20, as is depicted.

The distal end of each strap member 28, 30 is attached to enclosure member 20 by heat sealing or other suitable technique; unlike tube member 22, strap members 28, 30 are not hollow and are not confluent with the interior of enclosure member 20 and thus serve as enclosure support means but do not serve as fill spout means.

In this second embodiment, water is instead introduced into enclosure 20 through closure means 34 which is positioned centrally of base member 18, at the bottom thereof.

Closure means 34 is employed in both the first and second embodiments of the present invention; it is shown in detail in FIGS. 9, 10 and 11.

It will there be seen that closure means 34 includes an externally threaded spout member 36. Plug member 38 is press fit into spout member 36 and an internally threaded cap member 40 screw threadedly engages the threads on spout member 36 and overlies said plug member 38 to securely hold it in place.

The assembled configuration of said closure means parts is depicted in FIGS. 10 and 11. In both embodiments, a heat seal is applied about flange 43 which is an integral part of wall 42 of closure means 34 when closure means 34 is heat sealed to the body of toy 10.

The careful observer will note that the enclosure member 20 of the second embodiment is maintained in a slightly different configuration than the enclosure means 20 of the first embodiment. This emphasizes the point that the exact shape of the enclosure member 20 is not critical per se, although it is desirable that the lowermost portion of enclosure 20 have a larger water-containing capacity than the upper portion thereof so that the counterweight effect of the water is fully harnessed.

The innovative features of this invention are many; those skilled in the mechanical arts can now make numerous modifications to the inventive structure, which modifications are not expressly depicted herein in order to avoid needless waste of paper, but all embellishments obvious to those of ordinary skill in the pertinent art are within the scope of this invention.

For example, tube 22 could be positioned in a horizontal plane, i.e., its proximal and distal end could be at the same height; the device would still work even if the proximal end of the tube were positioned lower than the distal end. In such an undesirable configuration, water could collect in the tube 22, but theoretically such a mounting of tube 22 could still maintain the desired configuration of the flexible enclosure means 22 at all times. Many other modifications could be made as well and still be covered by the claims which follow.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A free standing, self-righting punching bag toy, comprising:

an upstanding, inflated body means having sculpted limb members projecting outwardly therefrom;

a base means forming a part of said body means;

a counterweight means positioned atop said base means;

said counterweight means including an enclosure means adapted to retain liquid therein;

said enclosure means having the general shape of a cone means wherein a bottom portion of said enclosure means has a greater diameter than a top portion thereof and wherein a gradual transition is made between said bottom portion and said top portion;

support means for maintaining said shape;

fill spout means for introducing liquid into said enclosure means;

and said support means and said fill spout means provided in the form of an elongate hollow tube member having a distal end confluent with said top portion of said enclosure means and having a proximal end fixedly secured to an internal sidewall of said body means at a point elevated at least as high as the distal end of said hollow tube member.

2. A free standing, self-righting punching bag, comprising:

an upstanding, inflated body means;

a substantially flat base means formed as a part of said body means;

a flexible, liquid-filled enclosure means having a bottom portion fixedly mounted atop said base means;

a fill spout means for introducing liquid into said enclosure means;

and a support means for maintaining a predetermined shape of said enclosure means when said body means is disposed in an angular position inclined from its upstanding position;

said support means being a hollow tube member having a distal end confluent with said enclosure means at an uppermost point of said enclosure means and having a proximal end secured to an internal sidewall of said punching bag at a point at least as high as the distal end of said tube member.

3. The punching bag of claim 2, wherein said fill spout means is positioned at the proximal end of said hollow tube member so that water is introduced into said enclosure means through said fill spout means.

4. The punching bag of claim 3, wherein said body means includes sculpted limb members projecting outwardly therefrom.

5. The punching bag of claim 4, wherein said fill spout means is countersunk with respect to the body portion of said punching bag.

6. The punching bag of claim 5, further comprising a closure means for capping said fill spout means.

7. The punching bag of claim 6, wherein said closure means includes a plug member press fit into said fill spout means.

8. The punching bag of claim 7, wherein said closure means further includes a cap member that overlies said plug member and which screw threadedly engages said fill spout means.

9. The punching bag of claim 3, wherein said liquid-filled enclosure means is generally cone-shaped.

10. The punching bag of claim 3, wherein said enclosure means is hemispherical in configuration.

11. A free standing, self-righting punching bag toy, comprising:

an upstanding, inflated body means having sculpted limb members projecting outwardly therefrom;

a base means forming a part of said body means;

a counterweight means positioned atop said base means;

said counterweight means including an enclosure means adapted to retain liquid therein;

said enclosure means having a hemispherical shape;

support means for retaining said shape;

strap means having a distal end fixedly secured to a top portion of said enclosure means and having a proximal portion fixedly secured to an internal sidewall of said body means, the proximal end of said strap means being positioned at least as high as the position of the distal end thereof;

the length of said strap means being preselected to maintain the hemispherical shape of said enclosure means even when said body means is knocked over from its upstanding position;

and fill spout means for introducing liquid into said enclosure means.

12. A free standing, self-righting punching bag, comprising:

an upstanding, inflated body means;

a substantially flat base means formed as a part of said body means;

a flexible, liquid-filled enclosure means having a bottom portion fixedly mounted atop said base means;

a fill spout means for introducing liquid into said enclosure means;

and a support means for maintaining a predetermined shape of said enclosure means when said body means is disposed in an angular position inclined from its upstanding position;

said support means including a pair of strap members having respective distal ends secured to said enclosure means and having respective proximal ends secured to a sidewall of said body means at a point at least as high as said respective distal ends.

13. The punching bag of claim 12, wherein said enclosure means is hemispherical in configuration.

14. The punching bag of claim 13, wherein said body means includes sculpted limb members projecting outwardly therefrom.

15. The punching bag of claim 14, wherein said fill spout means is disposed on the bottom of said base means.

16. The punching bag of claim 15, wherein said fill spout means is countersunk with respect to said base means.

17. The punching bag of claim 16, wherein said fill spout means includes a closure means for retaining liquid in said enclosure means.

18. The punching bag of claim 17, wherein said closure means includes a plug member press fit into said fill spout means and a cap member that overlies said plug member and which screw-threadedly engages said fit spout means.

* * * * *